US010724294B2

(12) United States Patent
Guerra et al.

(10) Patent No.: US 10,724,294 B2
(45) Date of Patent: Jul. 28, 2020

(54) SPOOL ASSEMBLY FOR A BLIND SYSTEM

(71) Applicant: Rollease Acmeda Pty Ltd, Broadmeadows Victoria (AU)

(72) Inventors: Alirio E. Guerra, Mills Park Victoria (AU); Dean John Jay, Gladstone Park (AU)

(73) Assignee: Rollease Acmeda Pty Ltd, Broadmeadows VIC (AU)

( * ) Notice: Subject to any disclaimer, the term of this patent is extended or adjusted under 35 U.S.C. 154(b) by 160 days.

(21) Appl. No.: 15/552,185

(22) PCT Filed: Feb. 18, 2016

(86) PCT No.: PCT/AU2016/000051
§ 371 (c)(1),
(2) Date: Aug. 18, 2017

(87) PCT Pub. No.: WO2016/131086
PCT Pub. Date: Aug. 25, 2016

(65) Prior Publication Data

US 2018/0155981 A1 Jun. 7, 2018

(30) Foreign Application Priority Data

Feb. 20, 2015 (AU) ..... 2015900591
Feb. 20, 2015 (AU) ..... 2015900593
Feb. 20, 2015 (AU) ..... 2015900596

(51) Int. Cl.
*E06B 9/322* (2006.01)

(52) U.S. Cl.
CPC ..... *E06B 9/322* (2013.01); *E06B 2009/3225* (2013.01)

(58) Field of Classification Search
CPC ..... E06B 9/322; E06B 2009/3225; E06B 2009/3227; E06B 9/304; E06B 9/305; E06B 9/306; E06B 9/32
USPC ..... 242/598, 598.3, 598.6, 599.3
See application file for complete search history.

(56) References Cited

U.S. PATENT DOCUMENTS

2004/0144501 A1* 7/2004 Oskam ..... E06B 9/322 160/173 R
2006/0042763 A1* 3/2006 Le Ru ..... E06B 9/308 160/171
2010/0147470 A1* 6/2010 Wong ..... E06B 9/322 160/370

(Continued)

FOREIGN PATENT DOCUMENTS

CN 2035884275 5/2014
WO WO2014172493 10/2014

*Primary Examiner* — Katherine W Mitchell
*Assistant Examiner* — Jeremy C Ramsey
(74) *Attorney, Agent, or Firm* — Head, Johnson, Kachigian & Wilkinson, PC

(57) ABSTRACT

A spool assembly for a blind system comprising: a spool rotatable about a longitudinal axis, the spool having a cord collecting portion to collect and release a cord for extending and retracting a blind; and a support for the spool, to support the spool during rotation of the spool about the longitudinal axis, the support comprising: a first support component to support the spool towards the cord collecting portion of the spool; and a second support component locate the first support component with respect to a housing of the blind system, wherein the first and second support components are separable.

15 Claims, 6 Drawing Sheets

(56) References Cited

U.S. PATENT DOCUMENTS

| | | | | |
|---|---|---|---|---|
| 2010/0175838 | A1* | 7/2010 | Faller | E06B 9/322<br>160/310 |
| 2016/0222722 | A1* | 8/2016 | Schulman | E06B 9/322 |

* cited by examiner

SPOOL ASSEMBLY FOR A BLIND SYSTEM

FIELD

The present invention relates generally to a fitting for blind systems, and in particular a spool assembly for collecting and releasing a cord in a blind system. The present invention will be described with particular reference to Roman blinds, although it has a more general application to other blinds which collect or release a cord.

INCORPORATION BY REFERENCE

The specification claims priority from Australian provisional application nos, 2015900591, 2015900593 and 2015900596. The entire contents of each of these specifications is hereby incorporated by reference.

BACKGROUND

In this specification where a document, act or item of knowledge is referred to or discussed, this reference is not an admission that the document, act or item of knowledge or any combination thereof was at the priority date, publicly available, known to the public, part of the common general knowledge; or known to be relevant to an attempt to solve any problem with which this specification is concerned.

A Roman blind system typically comprises a blind made of a number of fabric panels that draw vertically up over each other. Operation of a Roman blind system typically involves a user-operated drive mechanism, a shaft engaging the drive mechanism, one or more spool assemblies engaged by the shaft, a head rail containing the one or more spool assemblies, and one or more cords engaging the panels of the blind. The user-operated drive mechanism may be manually operated or could be motor operated. Operation of the chain causes the drive mechanism to rotate the shaft and one or more spool assemblies to collect or release the cords thereby causing extension or retraction of the blind.

Each spool assembly typically comprises a spool and a cradle to support the spool and allow it to rotate about its longitudinal axis. In order to permit assembly, the cradle is usually fabricated in dimensions allowing for a degree of movement or 'play' relative to the spool. However, during operation the parts of the spool assembly including the spool and the cradle may move relative to each other, which can increase the overall noise of the system. Over time, as the components wear, the relative movement between the components during use is likely to increase as the components wear, further increasing the noise of the system.

It is therefore desired to address the above issue, or at least provide a useful alternative to existing spool assemblies.

SUMMARY

According to an aspect of the present invention, there is provided a spool assembly for a blind system comprising:

a spool rotatable about a longitudinal axis, the spool having a cord collecting portion to collect and release a cord for extending and retracting a blind; and a support for the spool, to support the spool during rotation of the spool about the longitudinal axis, the support comprising:

a first support component to support the spool towards the cord collecting portion of the spool; and a second support component to locate the first support component with respect to a housing of the blind system, wherein the first and second support components are separable.

Providing the first and second support components as separable components allows them to be made from different materials, and in particular allows a portion of the support to be manufactured from a higher abrasion resistant material, and/or to be manufactured to a higher degree of precision.

The first support component may be a cord guide for guiding a cord around the cord collecting portion of the spool. Abrasion in a spool assembly is commonly caused by engagement with the cord, and so the cord guide may be more susceptible to wear than other components of the spool assembly. Accordingly, it may be formed from a higher abrasion resistant material. To reduce manufacturing costs, however, the cord guide 130 may be kept relatively small.

In some embodiments, the support may only support the spool at one point along its longitudinal axis; the assembly may rely on a connection between the spool and a rotatable shaft of the blind system, in order to keep the spool stable as it rotates during extension or retraction of the blind. However, in other embodiments, the support may support the spool at two or more points along its longitudinal axis. In particular, the second support component may be a cradle which engages and supports the cord guide towards the cord collecting portion of the spool, and extends substantially along the length of the spool to support it at its opposite end. The cradle may not engage the cord to any great extent, and so is likely to be less susceptible to wear than the cord guide. Accordingly, it may be formed from a lower abrasion resistant material.

The spool may comprise a spool cone to provide the cord collecting portion, and an end cap at the opposite end from the cord collecting portion.

It is also desirable to reduce the degree of 'play' between the spool and the support. The reduced degree of 'play' reduces the overall noise of the system when used and may also lead to a longer usable life. In an embodiment of the present invention, movement of the spool along the longitudinal axis is restrained by corresponding formations provided on the spool and the support. In particular, the formation on the support may be provided on the first support component (cord guide, in the preferred embodiment), which may in turn be manufactured to a higher degree of precision than the second support component (cradle, in the preferred embodiment). Manufacturing the cord guide to a higher degree of precision will reduce the play between the cord guide and the spool. Again, however, the cord guide 130 can be kept relatively small, so that manufacturing it to higher precision (and/or from more abrasion resistant materials) does not significantly impact the overall cost to manufacture the system.

The spool assembly may further have a threaded member to force the support into engagement with the housing. The threaded member may be operable (e.g. when tightened into an aperture of one of the support components) to force the first support component away from the second support component, to tighten the fit of the support within the housing.

According to another aspect of the present invention, there is provided a spool assembly comprising:

a spool rotatable about a longitudinal axis, the spool having a cord collecting portion to collect and release a cord for extending and retracting a blind; and a support for the spool, to support the spool during rotation of the spool about the longitudinal axis, the support comprising:

a first support component to support the spool towards the cord collecting portion of the spool; and a second support component to locate the first support component with respect to a housing of the blind system, wherein the first support component is composed of a different material to the second support component.

According to another aspect of the present invention, there is provided a spool assembly comprising:

a spool rotatable about a longitudinal axis to collect and release a cord for extending and retracting a blind;

a support for the spool; and corresponding formations provided on the spool and the support that engage each other to restrain axial movement of the spool.

Preferably, the corresponding formations comprise a flange on one of the spool or the support, and a recess on the other of the spool or the support. The recess can be a slot formed between different components of the support. Alternatively, the recess can be a slot on one component of the support. Still alternatively, recess can be formed on the spool, and a protrusion or flange formed on the support.

According to another aspect of the invention, there is provided a spool assembly comprising:

a spool rotatable to control the collection and release of a cord for extending and retracting a blind;

a support for the spool, the support being locatable within a housing; and a threaded member to force the support into engagement with the housing.

Preferably, the threaded member forces one or more parts of the support into engagement with the housing. For example, in a preferred embodiment, the support has multiple components that can be expanded relative to each other through the forcing action of the threaded member between them. Expansion of these components can tighten their fit within the housing.

In a further aspect of the invention, there is provided a blind system comprising:

a blind;

drive means to extend or retract the blind;

a cord connected to the blind; and one or more spool assemblies according to the first aspect of the present invention, to collect and release the cord as the blind is extended or retracted.

A detailed description of one or more embodiments of the invention is provided below, along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents.

For the purpose of example, numerous specific details are set forth in the following description in order to provide a thorough understanding of the present invention. The present invention may be practiced according to the claims without some or all of these specific details. For the purposes of clarity, technical material that is known in the technical fields related to the invention has not been described in detail so that the present invention is not unnecessarily obscured.

For the purposes of providing a clear description of the present invention, terms such as "front", "rear" and "side" are used in the below descriptions. This terminology will be understood to be for illustrative purposes only, and does not limit the scope of the present invention.

BRIEF DESCRIPTION OF THE DRAWINGS

Various embodiments/aspects of the invention will now be described with reference to the following drawings in which.

DETAILED DESCRIPTION

Figure 1:
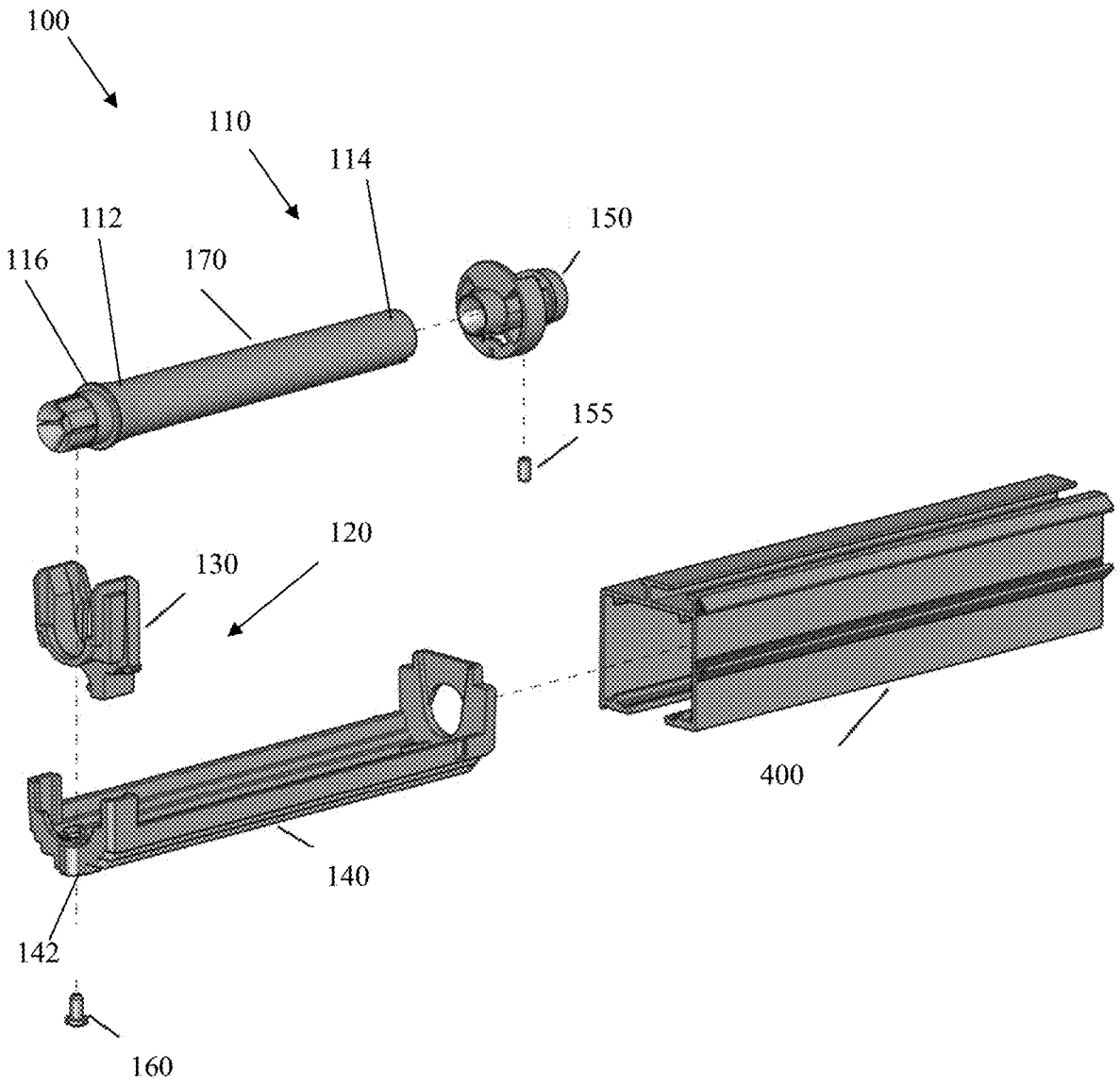
FIG. 1 is an exploded view of a spool assembly according to an embodiment of the present invention.
Figure 2:
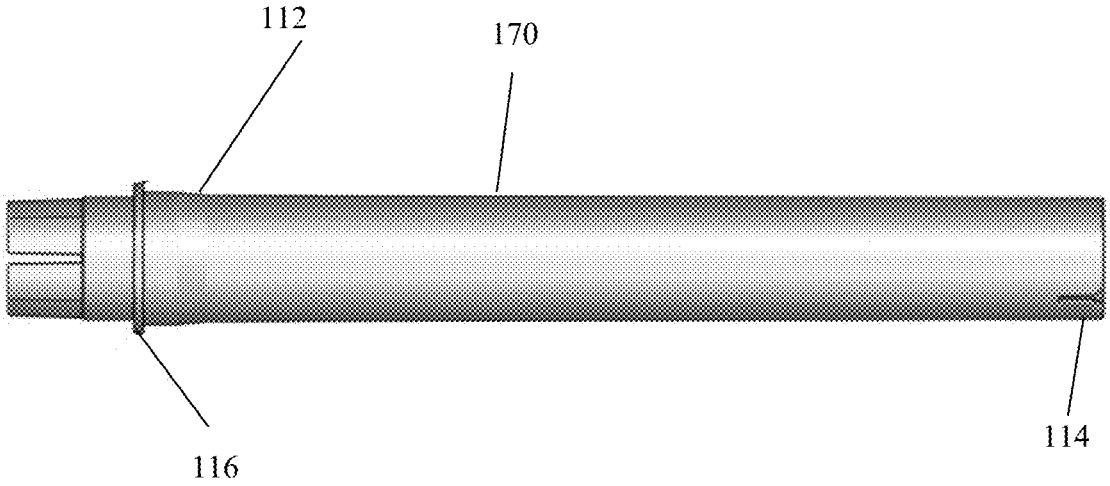
FIG. 2 is a front view of a spool according to an embodiment of the present invention.
Figure 3:
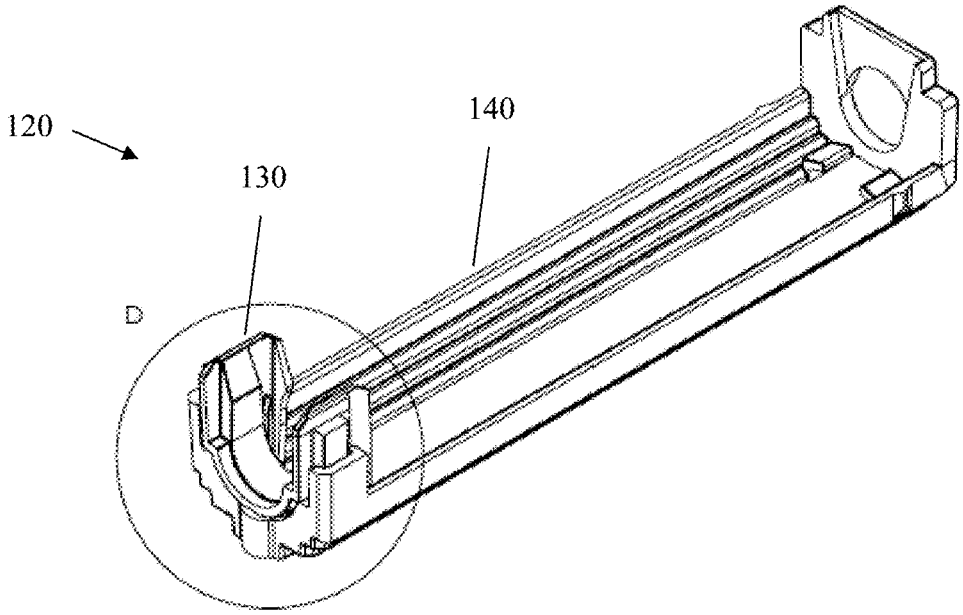
FIG. 3 is a perspective view of part of a spool assembly according to an embodiment of the present invention, with some parts assembled.
Figure 4:
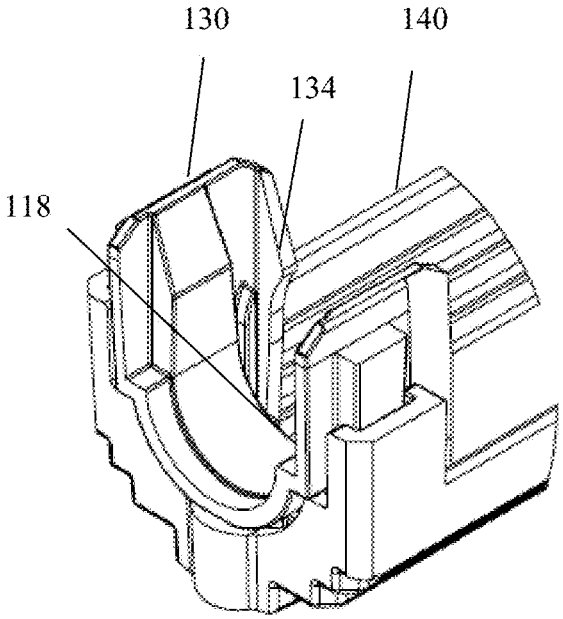
FIG. 4 is an enlarged view of a portion D of the perspective view of FIG. 3.
Figure 5:
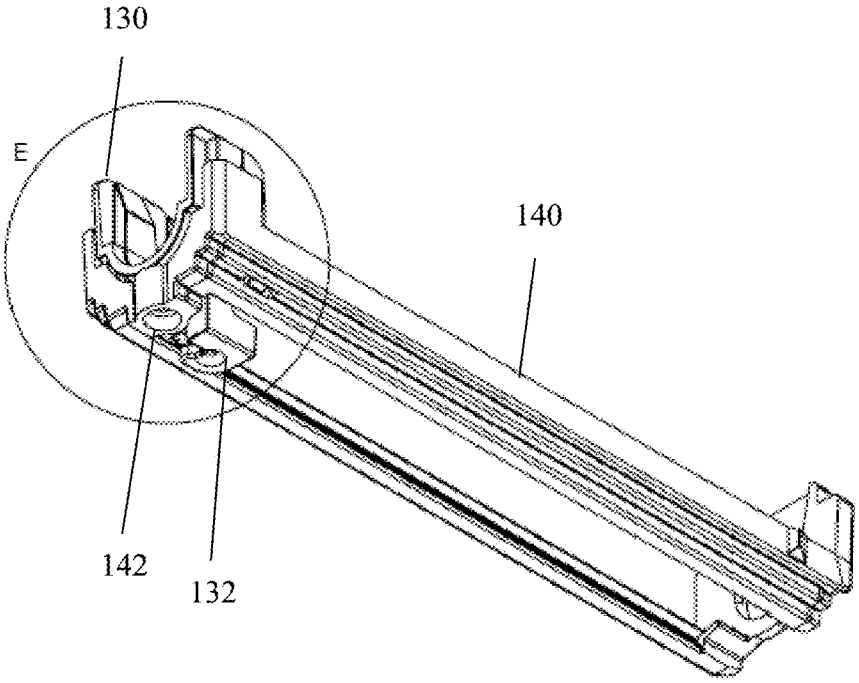
FIG. 5 is perspective view of part of a spool assembly according to an embodiment of the present invention, with some parts assembled.
Figure 6:
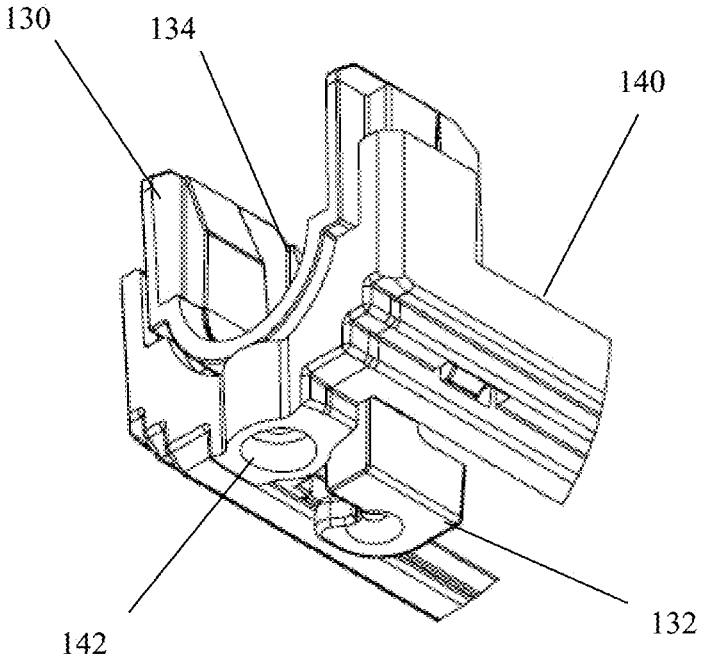
FIG. 6 is an enlarged view of portion E of the perspective view of FIG. 5.

A spool assembly 100, as shown in FIG. 1, comprises a spool 110 and a support 120 for the spool. The spool 110 comprises a spool cone 170 and end cap 150. The support 120 comprises a number of components, including (in this embodiment) a cord guide 130 and a cradle 140 engageable with the cord guide. The spool assembly 100 is located within a head rail, in the form of a longitudinal extrusion 400, and the end cap 150 is connected to a rotatable shaft (not shown) for extending and retracting a blind; optionally, the end cap may be clamped more tightly onto the shaft through use of grub screw 155. Two or more spool assemblies 100 may be connected to the rotatable shaft (e.g. a spool assembly 100 at each end of the shaft). The head rail 400 in turn would then be mounted adjacent an opening, such as on a wall or a door or a window frame.

In the preferred embodiment depicted in the figures, spool 110 comprises a spool cone 170 having a cord collecting portion 112 towards one end, and an end cap 150 at the opposite end. The end cap 150 connects to an end 114 of the spool cone 170. Spool 110 is supported along its longitudinal axis by the support 120—in particular, the cord guide 130 supports the spool cone 170 towards the end of the cord collecting portion 112, and the cradle 140 supports the end cap 150. The cradle 140 is also shaped to fit securely within the headrail 400, so that it locates the cord guide 130 with respect to the headrail 400. The spool 110 can rotate relative to the support 120 around its longitudinal axis.

In operation, a cord (not shown) for a Roman blind can be attached to the end cap 150, and extended substantially along the length of the spool 110 to be fed through a guide portion of the cord guide 130, in the form of eyelet 132. The other end of the cord is connected to the blind. Rotation of the spool 110 about its longitudinal axis to operate the blind causes the cord to (when retracted) collect around the cord collecting portion 112 of the spool cone 170, or (when extended) release from the cord collecting portion 112. The cord guide 130 comprises not only eyelet 132, but also a pair of cord deflectors 134 to ensure that the cord is correctly positioned with respect to the cord collecting portion 112 of the spool cone 170. The angle of the taper of the cord collecting portion 112 can be selected to best suit the width and other properties of the cord, such that it coils neatly around the cord collecting portion 112.

In the preferred embodiment depicted in the figures, cord guide 130 and cradle 140 are manufactured as separable components. Cord guide 130 and cradle 140 are preferably manufactured using different materials. For example, the cord guide 130 is particularly susceptible to wear caused by abrasion from the cord, as it rubs against the cord guide 130 during operation. Accordingly, the cord guide 130 can be manufactured using a higher abrasion resistant material such as a relatively high grade of nylon, whilst cradle 140 can be manufactured using a less abrasion resistant material such as a lower grade of nylon. It will be appreciated that the use of higher abrasion resistant materials to manufacture the cord guide 130 will lead to less wear of the cord guide 130 over time, which can lead to less friction between the cord and the cord guide 130 and better system performance.

The cord can be of any material and any thickness suitable for use in blind systems. For example, the cord could be a 1.0 mm thick polyester cord. Of course, other widths and types of cords could be used without departing from the scope of the invention. Thinner cords are generally considered less intrusive (i.e. less visible) but tend to result in faster abrasion than thicker cords.

The preferred embodiment of the present invention allows for the use of a spool 110 with a slim profile (i.e. a relatively small diameter). This allows for a higher lifting capacity of the system (relative to systems with larger diameter spools), for an applied torque. However, it will be appreciated that the higher load also results in more abrasion between the cord and the spool assembly. The preferred embodiment of the present invention helps to balance the competing design aims of better abrasion resistance and lower manufacturing cost.

Figure 7:
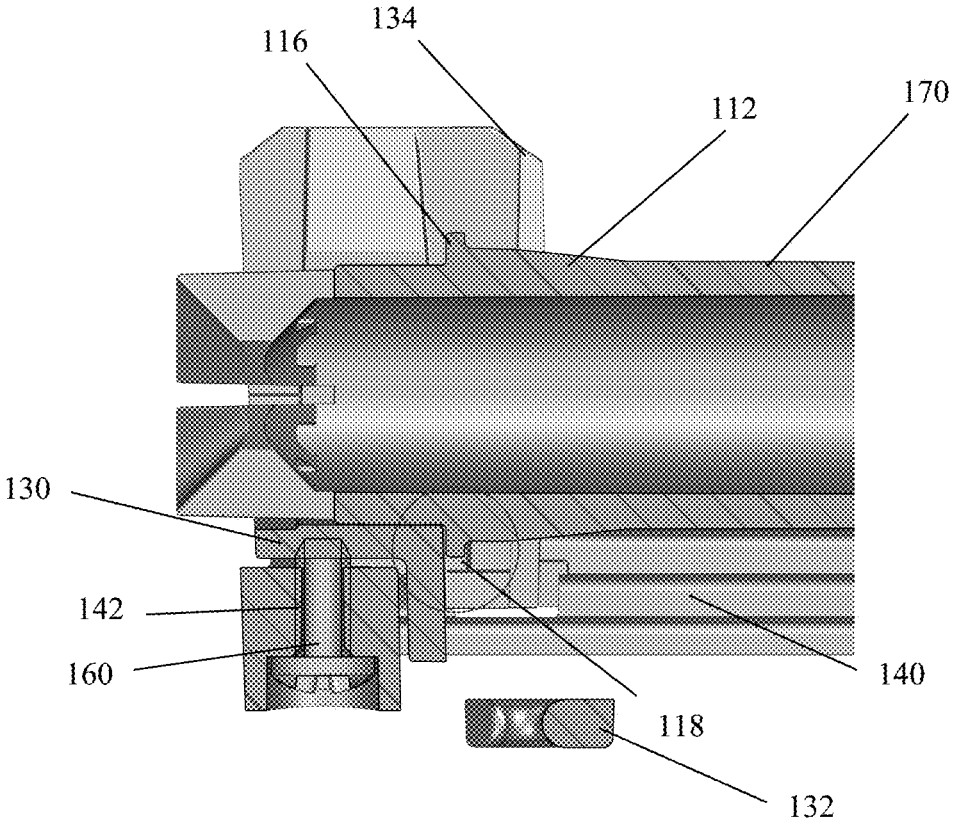
FIG. 7 is a front section view of a portion of the spool assembly according to an embodiment of the present invention, with some parts assembled.

In the preferred embodiment depicted in the figures, spool cone 170 and support 120 comprise corresponding formations to restrict movement of the spool 110 along its longitudinal axis. As shown in FIG. 7, corresponding formations may be a flange 116 on spool cone 170 and a recess in the form of a slot 118 in the cord guide 130. In use, the flange 116 locates within the slot 118, thereby holding the spool cone 170 against longitudinal/axial movement.

The corresponding formations (flange 116 and slot 118) are located at only one end of the support 120 and spool 110. Accordingly, the relative axial movement between the spool 110 and the support 120 is not dependent on the precision of the manufacture of the entire cradle 140, extending along the length of the spool. Rather, relative axial movement is limited by the fit between the corresponding formations at the end of the spool cone 170 and cord guide 130. Improvement of this fit reduces the 'play' between the spool cone 170 and the cord guide 130, leading to an overall better and quieter operation of the system. Because the cord guide 130 is separate to the cradle, the fit between the spool cone 170 and the support 120 can be improved by manufacturing these components to a higher degree of precision (e.g. using higher precision materials or more tightly controlled manufacturing methods).

It will be appreciated that manufacturing using higher abrasion resistant materials and/or higher precision materials or manufacturing methods is likely to be more expensive than other materials or manufacturing methods. Accordingly, from a cost perspective, it is advantageous to have the support formed of separate components. In particular, advantages can be achieved by manufacturing the cord guide 130 from more expensive materials or manufacturing methods, without the need to use more expensive materials or manufacturing methods in relation to the entire support 120. Furthermore, the cord guide 130 can be kept to a relatively small size, so that manufacturing it of higher grade or higher precision materials does not significantly impact the overall manufacturing cost.

There are also advantages to manufacturing the spool 110 from different components (spool cone 170 and end cap 150). In particular, the end cap 150 can be made using noise dampening material, without compromising the strength and accuracy of the spool cone 170.

Figure 8:
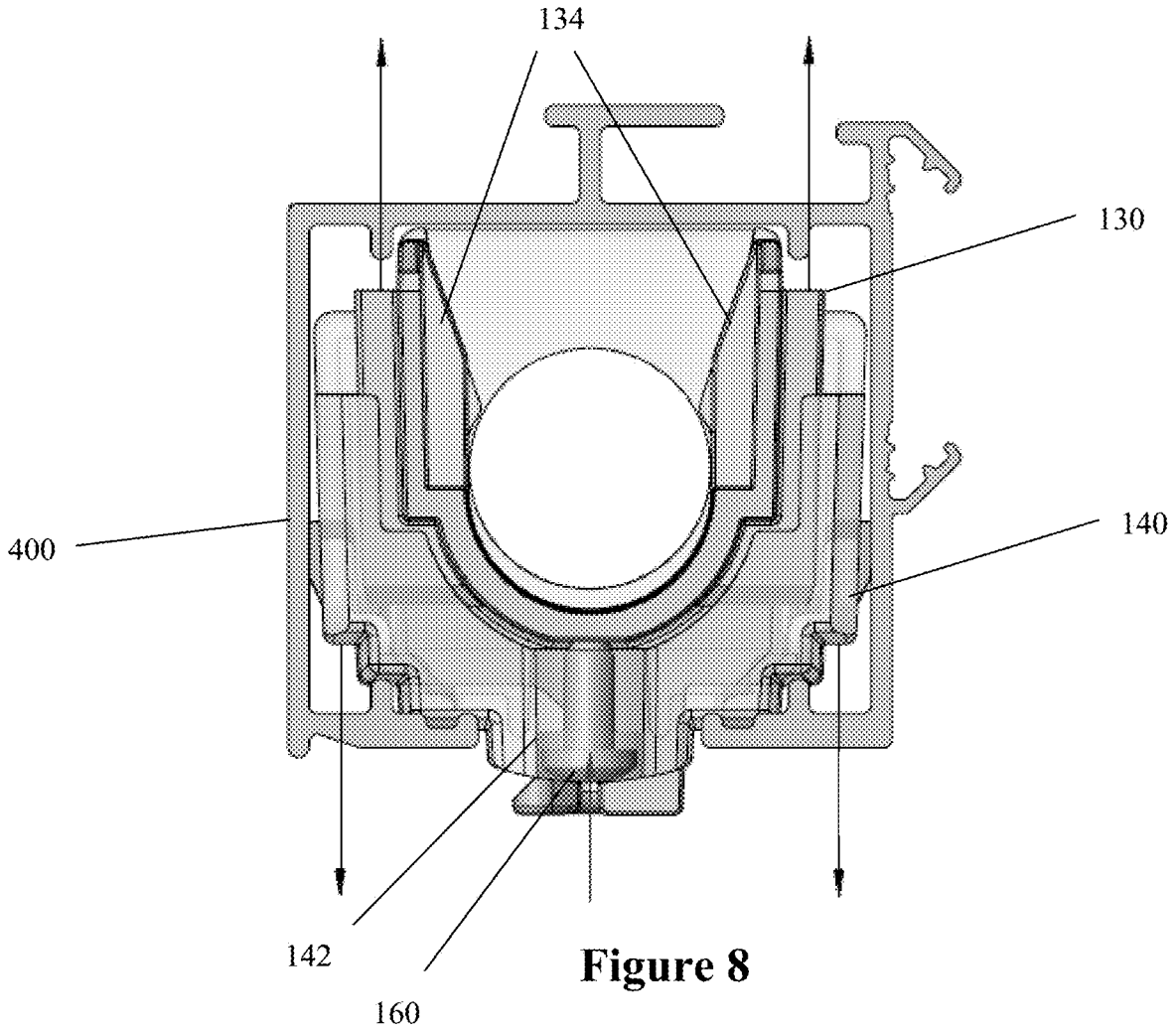
FIG. 8 is a side section view of the spool assembly showing some parts in phantom.

In the preferred embodiment depicted in the figures, spool assembly 100 comprises a threaded member in the form of a pan head screw 160 (although other types of threaded members would naturally be possible). Cradle 140 comprises opening 142 for engagement with screw 160 and allowing passage of screw 160 from one side of cradle to the other to contact cord guide 130. As shown by the arrows in FIG. 8, tightening the screw 160 pushes the end of the screw 160 against the cord guide 130 in an upwards direction. In turn, this forces the cord guide 130 up relative to the cradle 140, to contact the upper wall of extrusion 400. Further tightening of screw 160 forces cradle 140 down relative to cord guide 130 to contact lower wall of extrusion 400, thereby expanding the support components and ensuring a tight fit between the cord guide 130, cradle 140 and extrusion 400. Of course, other configurations of screw 160 and opening 142 are possible (e.g. to ensure a tight fit between the support 120 and the side walls of extrusion 400).

In use, a user operates a drive mechanism (e.g. a chain- or cord-driven mechanism) which rotates a shaft (not shown) about a longitudinal axis of shaft. This rotates the spool 110 which collects or releases the cord along the cord collecting portion 112 of the spool cone 170. Reducing the play between the various components (in particular between the housing and the cord guide 130 and cradle 140, and between the cord guide 130 and spool cone 170) results in less noise during operation of the blind system.

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention. For example, although the present invention has been described with reference to Roman blinds, the present invention has application to similarly operated blinds such as pleated blinds where the cord is threaded through the blind fabric.

Variations would also be possible in the formations used to limit the axial movement of the spool 110 relative to the support 120. For example, a recess could be formed in the spool cone 170 to receive a protrusion on the cord guide 130. Alternatively, a recess could be formed cooperatively between the cord guide 130 and cradle 140.

As another example, in some embodiments the support may only support the spool at one point along its longitudinal axis—particularly if the assembly makes use of a feature such as grub screw 155 or other fastener to secure the spool 110 to the shaft. In such cases, the assembly may rely on the connection between the spool and a rotatable shaft of the blind system, in order to keep the spool stable as it rotates during extension or retraction of the blind. In such an embodiment, the connection between the spool cone 170 and the end cap 150 should also be secure, to keep the spool stable as it rotates during extension or retraction of the blind (with a positive means of engagement such as snap fitting components or separate fasteners to hold the spool cone 170 and end cap 150 together).

The invention claimed is:

1. A spool assembly for a blind system comprising:

a spool rotatable about a longitudinal axis, the spool having an enlarged end configured to collect and release a cord for extending and retracting a blind; and a support for the spool to support the spool during rotation of the spool about the longitudinal axis and restrain movement of the spool along the longitudinal axis, the support comprising:

a cord guide to support the spool towards the enlarged end of the spool; and a cradle to locate the cord guide with respect to a housing of the blind system, wherein the cord guide and the cradle are separable; and, wherein the housing comprises an upper wall and a lower wall; the spool assembly further comprising a member operable to force the cord guide towards the upper wall of the housing and the cradle towards the lower wall of the housing, thereby expanding the support to tighten the support within the housing.

2. The spool assembly of claim 1, wherein the cord guide and cradle are made of different materials.

3. The spool assembly of claim 2, wherein the different materials have different properties of abrasion resistance.

4. The spool assembly of claim 1, wherein the cord guide and cradle are manufactured to different degrees of precision.

5. The spool assembly of claim 1, wherein the cord guide is for guiding the cord around the enlarged end of the spool.

6. The spool assembly of claim 2, Wherein the cradle extends substantially along the length of the spool and supports the spool towards an opposite end to the enlarged end.

7. The spool assembly of claim 2, wherein the spool comprises:

a spool cone having the enlarged end; and an end cap connectable to the spool cone, to engage an end of the cord.

8. The spool assembly of claim 7, wherein the spool cone and the end cap are made of different materials.

9. The spool assembly of claim 8, wherein the end cap is made of a noise dampening material.

10. The spool assembly of claim 2, further comprising a fastener to secure the end cap to a shaft rotatable to extend or retract the blind.

11. The spool assembly of claim 1, further comprising a positive means of engagement between the spool cone and the end cap.

12. The spool assembly of claim 1, further comprising corresponding formations on the spool and the support that engage each other to restrain axial movement of the spool.

13. The spool assembly of claim 12, wherein the corresponding formations comprise a slot on the cord guide, and a flange on the spool.

14. The spool assembly of claim 1 wherein the member is a threaded member.

15. A blind system comprising:

a blind;

drive means to extend or retract the blind;

a cord connected to the blind; and one or more spool assemblies according to claim 1, to collect and release the cord as the blind is extended or retracted.

* * * * *